US006572930B2

(12) United States Patent
Kobayashi et al.

(10) Patent No.: US 6,572,930 B2
(45) Date of Patent: Jun. 3, 2003

(54) HOLDER FOR ELECTROLESS PLATING AND METHOD OF ELECTROLESS PLATING

(75) Inventors: Mikiya Kobayashi, Yokaichi (JP); Yoshihiko Takano, Otsu (JP); Kiyomi Sasaki, Omihachiman (JP); Hiroyuki Ukai, Shiga-ken (JP); Hidetsugu Hosomi, Shiga-ken (JP); Akira Imamura, Moriyama (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/170,501

(22) Filed: Jun. 14, 2002

(65) Prior Publication Data

US 2002/0150693 A1 Oct. 17, 2002

Related U.S. Application Data

(62) Division of application No. 09/421,725, filed on Oct. 20, 1999, now Pat. No. 6,471,777.

(30) Foreign Application Priority Data

Oct. 20, 1998 (JP) ..... 10-297875

(51) Int. Cl.[7] ..... B05D 1/18; B05D 3/12; B05D 5/12

(52) U.S. Cl. ..... 427/443.1; 427/98; 427/123; 427/346; 427/347

(58) Field of Search ..... 427/98, 123, 346, 427/347, 443.1

(56) References Cited

U.S. PATENT DOCUMENTS 3,798,056 A * 3/1974 Okinaka et al. ..... 118/409
4,077,416 A * 3/1978 Johnson et al. ..... 118/426
4,581,260 A * 4/1986 Mawla ..... 118/416
5,849,355 A * 12/1998 McHenry ..... 29/602.1

* cited by examiner

*Primary Examiner*—Michael Barr
(74) *Attorney, Agent, or Firm*—Dickstein, Shapiro, Morin & Oshinsky, LLP

(57) ABSTRACT

A holder for electroless plating to hold a plurality of ceramic elements for ceramic electronic parts during electroless plating treatment, each surface of said ceramic elements being to be electroless plated, said holder comprising a plurality of cells to house each of said plurality of ceramic elements separately, and each of said cells having such a structure as to permit the flow communication of a plating solution into the cell.

16 Claims, 6 Drawing Sheets

HOLDER FOR ELECTROLESS PLATING AND METHOD OF ELECTROLESS PLATING

This is a division of application Ser. No. 09/421,725, filed Oct. 20, 1999 now U.S. Pat. No. 6,471,777.

BACKGROUND OF THE INVENTION

1. Field of the Invention

The present invention is applied to the technical field where electrodes are formed by electroless plating on the surfaces of ceramic elements for ceramic electronic parts such as a dielectric resonator. More particularly, the invention relates to a holder for ceramic elements to be electroless plated, and a method of electroless plating utilizing this holder.

2. Description of the Related Art

Japanese Unexamined Patent Publication No. 1-234597, for example, describes that a plurality of ceramic elements for ceramic electronic parts are subjected to electroless plating in such a manner that they are loaded on a rotating barrel to form an electroless plated electrode of, for instance, copper on the surface of each of the ceramic elements.

Japanese Unexamined Patent Publication No. 8-134658 describes an electroless plating treatment in which a plurality of ceramic elements to be electroless plated are placed in a mesh bag and then loaded in a barrel.

Such methods of electroless plating utilizing a barrel as described in these publications often face a problem in that the ceramic elements to be electroless plated are liable to crack or to chip. In this connection, according to the method of electroless plating described in the latter Japanese Unexamined Patent Publication No. 8-134658, a plurality of ceramic elements to be electroless plated are placed in a mesh bag, and, therefore, such cracks or chipping of the ceramic elements can effectively be inhibited when the ceramic elements are placed into a barrel or are retrieved from the barrel.

The methods of electroless plating described in the aforementioned two publications cannot, however, avoid cracks or chipping of ceramic elements caused by a collision between the ceramic elements inside the barrel during the rotation of the barrel.

For the forgoing reasons, there is a need for a technique for avoiding the occurrence of such cracks and chipping as mentioned above in a method of electroless plating utilizing a plurality of ceramic elements. In particular, the formation of cracks and chipping in ceramic elements for a dielectric resonator must be strictly avoided.

SUMMARY OF THE INVENTION

Therefore, it is an object of the present invention to meet the above demands and to provide a holder for ceramic elements during electroless plating.

Another object of the present invention is to provide a method of electroless plating which is carried out utilizing such a holder for electroless plating as mentioned above.

The present invention is, in one aspect, directed to a holder for electroless plating to hold a plurality of ceramic elements for ceramic electronic parts during electroless plating treatment, in which each surface of the ceramic elements is to be electroless plated. To solve the above technical problems, the holder for electroless plating includes a plurality of cells to house each of the plurality of ceramic elements separately, and each of the cells has such a structure as to permit the flow communication of a plating solution into the cell.

This holder for electroless plating can particularly advantageously be applied when the ceramic elements are ceramic elements for a dielectric resonator.

In the holder for electroless plating according to the invention, the cells preferably form a contact which makes point contact or line contact with the ceramic elements.

Each of the cells preferably defines dimensions to give a clearance between each cell and each ceramic element, the clearance permitting each ceramic element to move inside the cell.

The holder for electroless plating according to the invention preferably has a configuration including a plurality of holder bodies each having an overall long shape and each forming a plurality of the cells distributed in the longitudinal direction, and a holder frame to hold the plurality of holder bodies arrayed two-dimensionally in such a manner that the longitudinal directions are oriented in the same direction.

In the aforementioned configuration, it is more preferable that each of the holder bodies includes at least two walls arranged in parallel with each other, and a plurality of pillar spacers to link the walls with each other at a plurality of points, and wherein each of the cells is defined by a portion interposed between the walls and surrounded by a plurality of the spacers.

It is further preferred that the plurality of holder bodies are arranged in such a manner that the walls of the individual holder bodies are arrayed two-dimensionally, and wherein the plurality of spacers to define each cell are constructed by two groups of spacers, one being located on one of first and second holder bodies adjacent to each other, and the other being located on the other of the adjacent first and second holder bodies, and wherein an opening is formed in each of the cells when the first and second holder bodies are separated from each other, the opening capable of receiving the ceramic element.

More preferably, gaps for the flow communication of the plating solution may be formed between the walls of the plurality of holder bodies arrayed two-dimensionally as described above.

The spacers are preferably circular in cross section, and the walls are preferably each provided with a height to reduce the contact area with the ceramic element.

The present invention is also directed to a method of electroless plating utilizing such a holder for electroless plating as mentioned above.

In this method of electroless plating, the following steps are conducted: providing the aforementioned holder for electroless plating, loading a ceramic element for ceramic electronic parts into a cell of the holder, and dipping the plurality of ceramic elements held by the holder in an electroless plating solution.

It is preferable that the holder is rotated or oscillated in the step of dipping the ceramic elements in the electroless plating solution.

For the purpose of illustrating the invention, there is shown in the drawings several forms which are presently preferred, it being understood, however, that the invention is not limited to the precise arrangements and instrumentalities shown.

DETAILED DESCRIPTION OF PREFERRED EMBODIMENTS

Figure 1A:
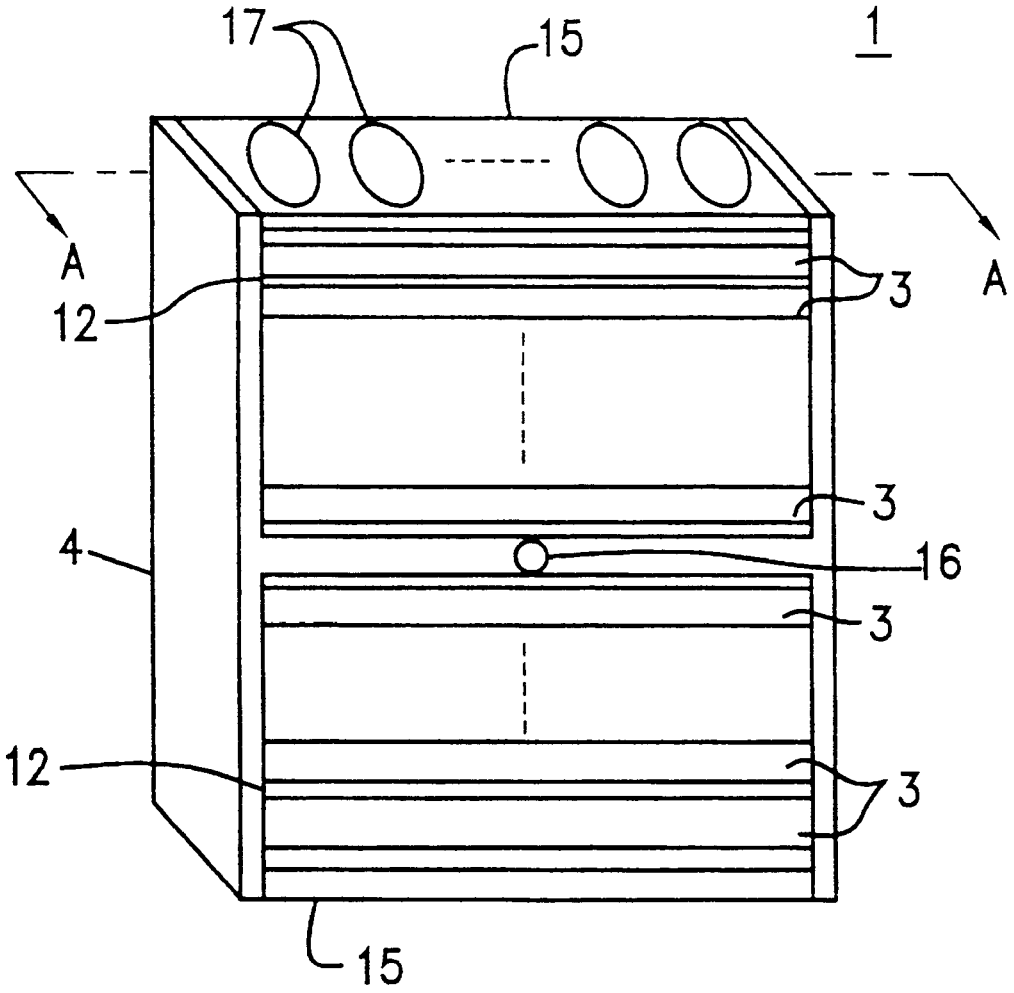
FIG. 1A is a perspective view of a holder 1 for electroless plating according to an embodiment of the present invention.
Figure 1B:
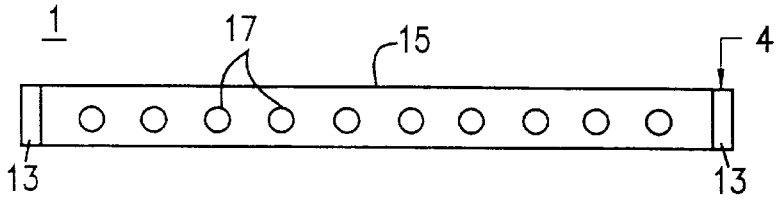
FIGS. 1B, 1C and 1D are a top view, a front view and a bottom view thereof, respectively.
Figure 1C:
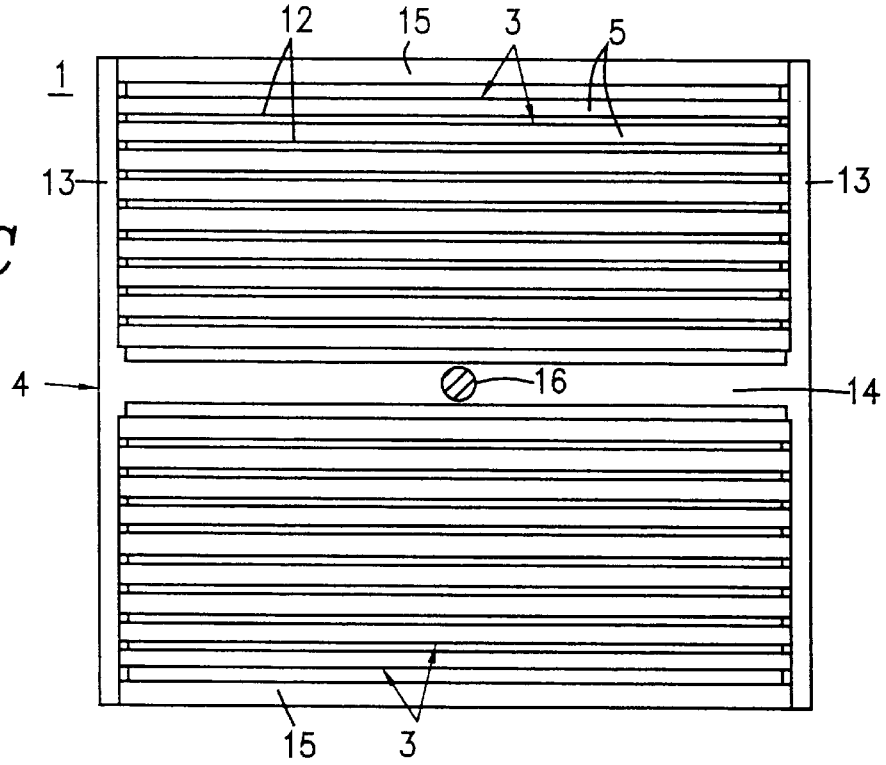
Figure 1D:
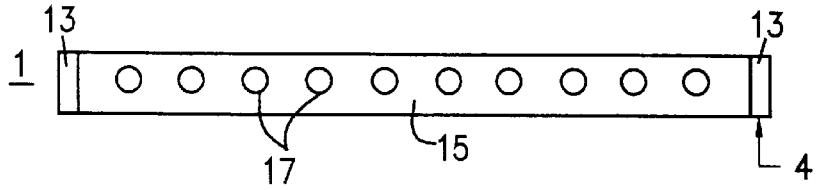

Hereinafter, the preferred embodiments of the present invention are explained in detail with reference to the drawings.

A shown in FIGS. 1A, 1B, 1C and 2, a holder 1 according to an embodiment of the present invention, comprises a plurality of, for example eighteen in the illustrated embodiment, holder bodies 3 each having an overall long shape, and holder frame 4 to hold the eighteen holder bodies 3 which are arrayed two-dimensionally in such a manner that the longitudinal directions of the holder bodies 3 are oriented in the same direction.

The eighteen holder bodies 3 are preferably identical in shape with one another. Each of the holder bodies 3 includes, as illustrated in detail in FIGS. 3A, 3B, 3C and 3D, three walls 5, 6 and 7 arranged in parallel with one another, and a plurality of pillar spacers 8 and 9 to link the walls 5 through 7 with each other at a plurality of points.

The holder body 3 forms a plurality of cells 10 (one cell 10 is shown by dashed lines in FIG. 3C) which are to house each of the plurality of ceramic elements 2 separately and are distributed in its longitudinal direction. In other words, each of the cells 10 is defined by a portion which is interposed between the walls 5 through 7 and surrounded by the plurality of spacers 8 and 9.

Figure 3A:
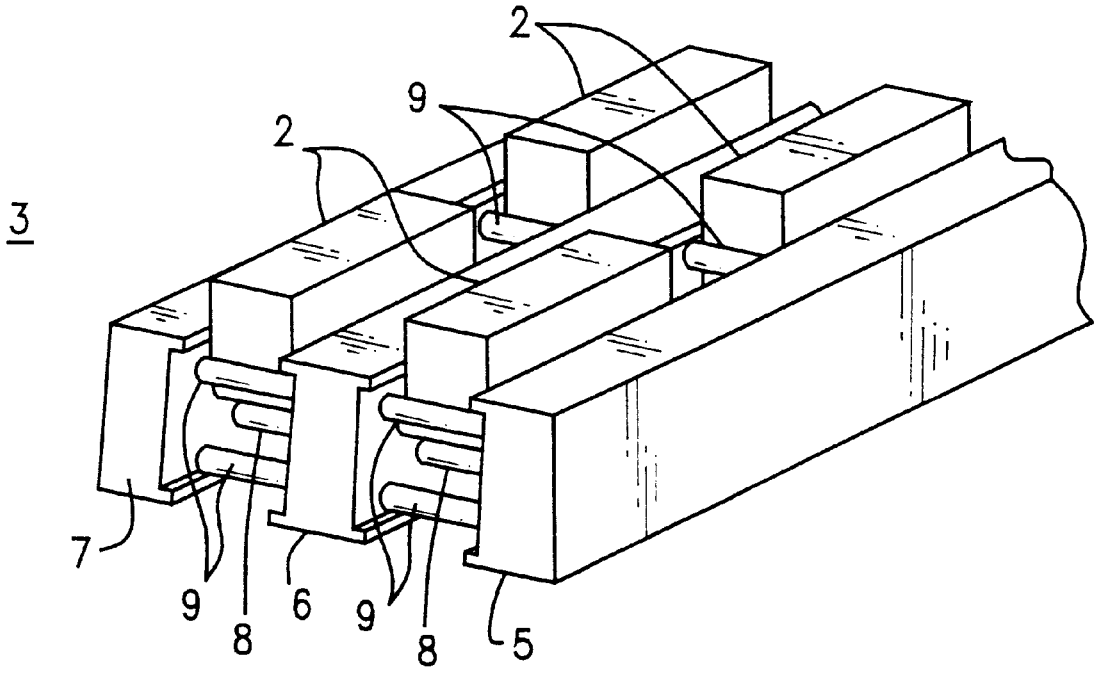
FIG. 3A is a partial perspective view of a holder body 3 of the holder 1 and FIG. 3B is a top view thereof.
Figure 3B:
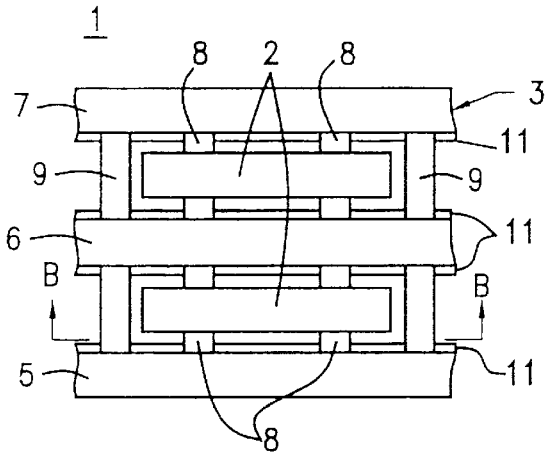
Figure 3C:
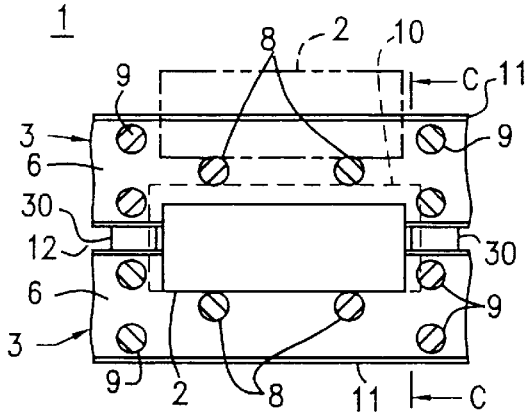
FIGS. 3C and 3D are cross sectional views taken along line B—B and line C—C in FIGS. 3B and 3C, respectively in which a pair of the holder bodies 3 are stacked.
Figure 3D:
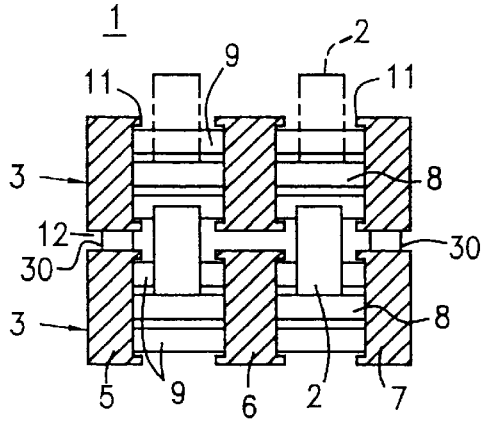

In this embodiment, the plurality of holder bodies 3 each have the walls 5 through 7 arranged in parallel with one another, and the plurality of spacers 8 and 9 to define each cell are, as shown in detail in FIGS. 3C and 3D, constructed by two groups of spacers, one located on one of first and second holder bodies 3 adjacent to each other, and the other being located on the other of the first and second holder bodies 3. When the first and second holder bodies 3 are separated from each other, an opening for receiving each ceramic element 2 is formed in each of the cells 10.

The plurality of spacers 8 and 9 to define each cell 10 are circular in cross section. Consequently, these spacers 8 and 9 provide contacts to make line contact with the ceramic element 2, thereby resulting in a reduced contact area with the ceramic element 2.

In this connection, the cross sectional shapes of the spacers 8 and 9 are not limited to circular and may be changed to rectangular. When the spacers 8 and 9 are rectangular in cross section, they can come in line contact with the ceramic element 2 by rendering the ridge of each spacer a contact with the ceramic element 2. Alternatively, conical protrusions may be formed on the surfaces of the spacers 8 and 9 facing the ceramic element 2, which protrusions provide contacts to make point contact with the ceramic element 2.

The walls 5 through 7 can each be provided with a height projecting toward the ceramic element 2, to be more specific, rib 11. By this configuration, when the ceramic element 2 approaches any of the walls 5 through 7 inside each cell 10, the ceramic element 2 comes into contact with the wall at the rib 11, thereby resulting in a reduced contact area between the wall 5, 6 or 7 and the ceramic element 2.

The ribs 11 are square in cross section in the illustrated embodiment, whereas they may be, for example, triangular in cross section to reduce the contact area further more. Alternatively, it is also possible that dotted projections are formed instead of the long ribs 11 to make substantially point contact with the ceramic element 2.

Each cell 10 defines dimensions to give a clearance between the cell and each ceramic element 2, which clearance permits each ceramic element 2 to move inside the cell.

To be more specific, each of the cells 10 initially form a clearance between each of the walls 5 through 7 and each ceramic element 2, as shown in FIG. 3B or FIG. 3C, and the ceramic element 2 is thus allowed to move in a direction close to or away from each of the walls 5 through 7.

Each cell 10 also forms a clearance between the spacers 8 and the ceramic element 2, as shown in FIG. 3C or FIG. 3D, and the ceramic element 2 is thus allowed to move in the up-and-down direction in these figures.

In addition, each of the cells 10 forms a clearance between the spacers 9 and the ceramic element 2, as shown in FIG. 3B or FIG. 3C, and the ceramic element 2 is therefore allowed to move in the side-to-side direction in these figures.

As thus described, each ceramic element 2 is allowed to move in any of three-dimensional directions inside each cell 10.

Figure 2:
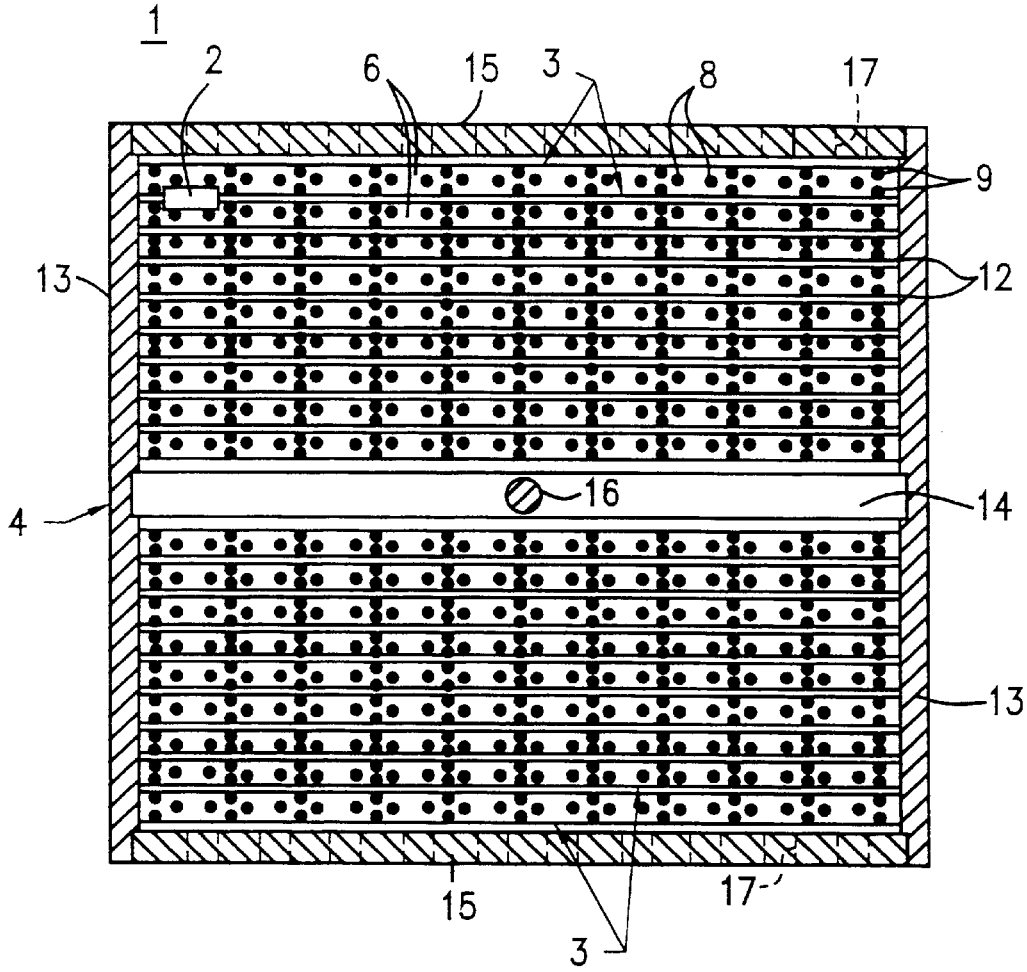
FIG. 2 is a cross sectional taken along the line A—A in FIG. 1A.

In FIG. 2, one ceramic element 2 is representatively illustrated. As illustrated, ten cells 10 to house each of the ceramic elements 2 separately are arranged in each of the holder bodies 3 in the longitudinal direction. These cells 10 are aligned in two rows in each of the holder bodies 3, as is shown in FIG. 3B or FIG. 3C. Consequently, each of the holder bodies 3 can hold a total of twenty ceramic elements 2. From this, when eighteen holder bodies 3 are used and all the cells 10 of all the holder bodies 3 house each of the ceramic elements 2, as in the illustrated embodiment, the holder 10 can hold a total of 360 ceramic elements 2.

The plurality of holder bodies 3 are arranged in such a manner that their walls 5 through 7 are two-dimensionally arrayed, and the plurality of holder bodies 3 thus arranged are held by the holder frame 4. In this case, the plurality of holder bodies 3 are preferably arranged in such a manner that gaps 12 for the flow communication of a plating solution are formed between the individual walls 5, 6 and 7.

The holder frame 4 is provided with a pair of guides 13, connecting unit 14 to link intermediate portions of these guides 13, and lid 15 which are detachably mounted on each end of the guides 13. In addition, shaft 16 which provides a center shaft around which the holder 1 is rotated or oscillated is located in the connecting unit 14. The holder 1, in which the individual ceramic elements 2 are housed in the individual cells 10 separately, is integrated, for example, in the following manner.

Initially, eighteen holder bodies 3 are prepared, and the ceramic elements 20 are separately loaded in each of twenty cells 10 provided in each of the holder bodies 3.

Next, the lids 15 of the holder frame are removed, and in this state, the eighteen holder bodies 3 are successively inserted to the holder frame 4. To be more specific, each nine holder bodies 3 are inserted via the connecting unit 14 to each side of the holder frame. Each holder body 3 has such a shape that its ends can slide and engage with the guides 13, and it is stacked along the guides 13.

In this step, it is preferable to locate a spacer 30 between adjacent plural holder bodies 3 in order to form gaps 12 for the fluid communication of a plating solution between the adjacent holder bodies. The spacer 30 may be formed integral with the holder bodies 3 or may be prepared as a separate member.

After all the holder bodies 3 are inserted, the lids 15 are fixed to the other parts of the holder frame 4. This fixation is achieved by screwing or otherwise engaging. The lids 15 serve to prevent the holder bodies 3 from dropping from, or moving off, the holder frame 4 and to prevent the ceramic elements 2 from dropping therefrom, which ceramic elements 2 are housed in the cells 10 in the holder body 3 last inserted.

The lids 15 are provided with through holes 17 corresponding to the positions of the individual cells 10 to permit the flow communication of a plating solution.

Figure 4A:
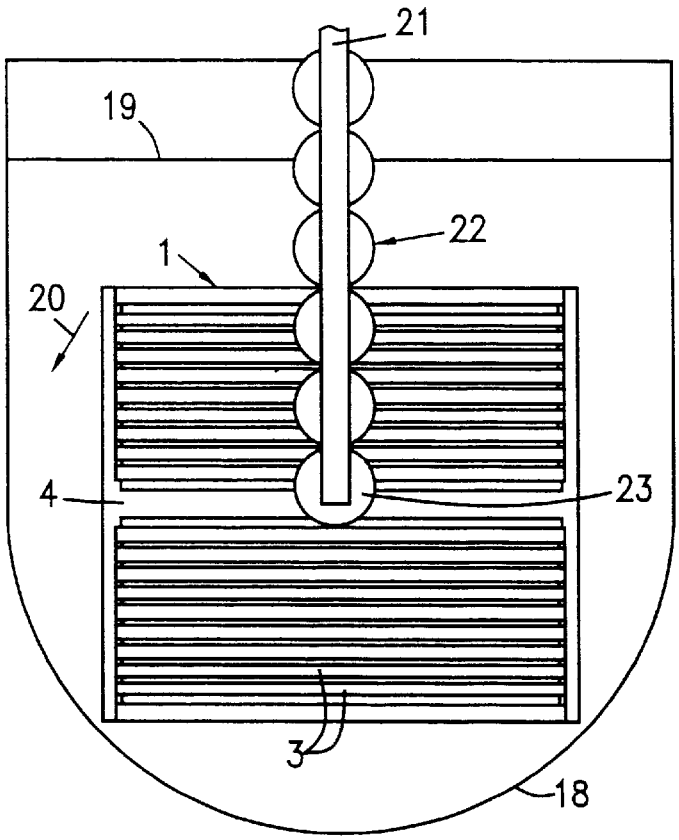
FIGS. 4A and 4B are a front view and a side view, respectively, illustrate the state where electroless plating is carried out using the holder 1 for electroless plating.
Figure 4B:
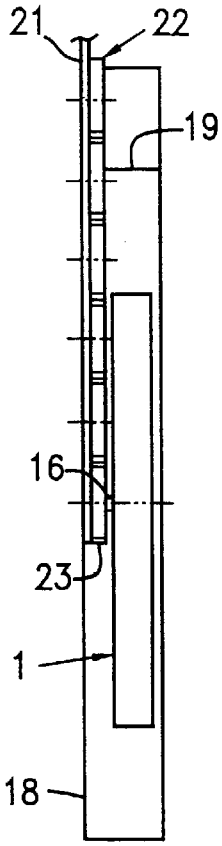

The thus-integrated holder 1 is inserted into plating tank 18, and the ceramic elements 2 are dipped in electroless plating solution 19, as shown in FIG. 4. In this step, the holder 1 is rotated around the aforementioned shaft 16 (refer to FIG. 1B or FIG. 2) as indicated by arrow 20.

To rotate the holder 1 in the above manner, the holder 1 is mounted via the shaft 16 on mounting member 21, and the mounting member 21 holds gear train 22 composed of a plurality of gears. On this gear train 22, a driving force is exerted from a motor not shown. By, for instance, fixing last gear 23 constituting the gear train 22 to the shaft 16, and then fixing the shaft 16 to the holder frame 4, the last gear 23 is allowed to rotate integrally with the holder 1.

As is described above, when the holder 1 is rotated, not only the flow communication of the electroless plating solution 19 is facilitated but also each ceramic element 2 moves inside each cell 10, and thereby continuous contact of a specific portion on the surface of the ceramic element 2 with any of the spacers 8 or 9 or the ribs 11 can be prevented. Consequently, a plated film, that is an electrode, can be formed uniformly all over the surface of the ceramic element 2 with more facility.

In this connection, an oscillation at an angle of less than 360 degrees, for example at 90 degrees, can be imparted to the holder 1 instead of the aforementioned rotation.

As individual materials of the holder bodies 3 and holder frame 4 each constituting the holder 1, any material, such as resins, can be used as far as they are not deteriorated at temperatures and with reagents which are applied in electroless plating treatment, and can maintain their shapes. As typical examples of such materials, use can be made of vinyl chloride resins (PVC), modified poly(phenylene ether) (PPE), and carbon-containing poly(ether sulfone) (PES) and the like. When copper electrodes are to be formed on the surfaces of ceramic elements 2 for, for instance, a Ti—Pb—Nd oxide-based dielectric resonator by using the above-described holder 1, the following individual steps are, for example, conducted.

Initially, the holder 1 is integrated with the ceramic elements 10 separately loaded into the individual cells 10.

Next, the following steps are successively conducted with respect to each ceramic element 2, while the ceramic element 2 is being held by the holder 1 as above: a step of degreasing with, for example, an aqueous silicate solution at 40 to 50 C for 10 minutes, a step of etching with, for example, an aqueous hydroboric acid solution at 30 to 40 C for 10 minutes, a step for sensitizing treatment with, for example, an aqueous tin(II) chloride solution at 20 to 30 C for 10 minutes, a step for activation with, for instance, an aqueous palladium chloride solution at 20 to 30 C for 10 minutes, a step of electroless plating with, for example, electroless plating solution 19 having a composition of copper sulfate-EDTA-formalin-NaOH at 40 to 50 C for 40 minutes to form a copper electrode, and a step of cleaning with ion-exchange water at 20 to 30 C for 15 minutes to stop the plating reaction and to remove attached plating components.

In these steps, the holder 1 is rotated in a treating tank for conducting each treatment. As the number of revolutions, for example, approximately 2 rpm is sufficient. Even when the number of revolutions as high as 8 rpm is given, the ceramic elements 2 are not cracked or chipped.

Ultimately, the ceramic elements 2 are dried with hot air at 70 to 80 C for 20 minutes to remove the cleaning water. This drying step may be carried out after the ceramic elements 2 are retrieved from the holder 1, or may be carried out while the ceramic elements 2 are being held by the holder 1. In the latter case, the drying step can be conducted while rotating the holder 1.

The present invention has been described with reference to the illustrated embodiment, but other embodiments and variations will be obvious to those skilled in the art within the scope of the invention.

As is described above, according to the present invention where electroless plating is conducted each ceramic element using a holder for electroless plating having a plurality of cells to house a plurality of ceramic elements separately, the ceramic elements do not come into contact with or collide with one another, and therefore the ceramic elements can be prevented from cracking or chipping. Consequently, ceramic elements having electrodes on their surface which are formed by electroless plating can be obtained with satisfactory quality and stability.

This invention is, therefore, particularly advantageous when it is applied to electroless plating treatment for forming electrodes on the surfaces of ceramic elements used for a dielectric resonator.

In the holder for electroless plating according to the invention, when the cells are allowed to form contacts which make point contact or line contact with the ceramic elements, the contact areas with respect to the ceramic elements can be reduced, and thereby electroless plated films on the surfaces of the ceramic elements can be deposited more uniformly.

When each cell defines dimensions to give a clearance with respect to each ceramic element, which clearance permits each ceramic element to move inside the cell, the plating solution inside each cell flows more smoothly. In addition, the ceramic element can be moved inside the cell by rotating or oscillating the holder for electroless plating, and thus continuous contact of a specific portion of the surface of each ceramic element with a specific portion of, for example, a wall which defines a space inside the cell can be prevented, thereby resulting in uniform deposition of electroless plated films.

When both the configuration which allows each ceramic element to move inside each cell, and the configuration where each cell forms a contact which makes point contact or line contact with each ceramic element are employed, the effect of allowing an electroless plated film to deposit uniformly can be further enhanced through both configurations.

In particular, the uniform formation of electroless plated films, i.e. electrodes, in ceramic elements for dielectric resonators contributes to improvement in Q (quality factor)

characteristics and hence dielectric resonators having high quality can be obtained.

When the holder for electroless plating according to the present invention comprises, as its configuration, a plurality of holder bodies each having an overall long shape and each forming a plurality of the cells distributed in the longitudinal direction, and a holder frame to hold the plurality of holder bodies arrayed two-dimensionally in such a manner that the longitudinal directions are oriented in the same direction, this facilitates to provide a configuration where one holder body has a multiplicity of cells formed thereon or a configuration where a multiplicity of holder bodies are held by a holder frame. Therefore, the number of ceramic elements to be held by the holder for electroless plating, that is, the number of ceramic elements to be treated by one electroless plating treatment, can be easily increased, and the efficiency of the electroless plating treatment can be enhanced.

Furthermore, a plurality of holder bodies each forming cells can be treated separately and independently in the holder for electroless plating, and the step for loading ceramic elements in the individual cells can be carried out with facility and efficiency.

As the holder frame holds the plurality of holder bodies being arrayed two-dimensionally, the overall holder for electroless plating can be comparatively thinned. Each of treating tanks such as plating tanks can therefore be thinned, resulting in the comparatively shortened length of the process line of facilities for electroless plating treatment.

By allowing each of the holder bodies to comprise at least two walls arranged in parallel with each other, and a plurality of pillar spacers to link the walls with one another at a plurality of points, and allowing each of the cells to be defined by a portion interposed between the walls and surrounded by the plurality of spacers, the configuration of the holder bodies can be simplified. This facilitates the manufacture of holder bodies by monolithic molding using resins, and facilitates impartment of high mechanical strength to the holder bodies. Furthermore, as a configuration where the walls of the holder bodies are connected only through the pillar spacers can be employed, the plating solution can smoothly flow into cells formed in the holder bodies.

In case that the plurality of holder bodies are held by the holder frame, the loading of each ceramic element into each cell can be facilitated in a configuration in which the plurality of holder bodies are arranged in such a manner that their individual walls are arrayed two-dimensionally, and the plurality of spacers to define each cell are constructed by two groups of spacers, one being located on one of the adjacent first and second holder bodies and the other being located on the other of the adjacent first and second holder bodies, and an opening is formed in each cell when the first and second holder bodies are separated from one another, the opening capable of receiving the ceramic element.

In the aforementioned configuration, when gaps for the flow communication of the plating solution are formed between the individual walls of the plurality of holder bodies arrayed two-dimensionally, the plating solution can flow into the cell more smoothly.

When the spacers are circular in cross section or the walls have a rib or another height, the contact area between the wall or the like defining a space inside the cell and the ceramic element can be reduced, resulting in further more uniform deposition of electroless plated films, as described above.

In the method of electroless plating according to this invention, the flow of the plating solution inside each cell and flow communication of the plating solution from outside to inside each cell are facilitated by rotating or oscillating the holder during the dipping step of the ceramic elements in an electroless plating solution. In this case, when each ceramic element is allowed to move inside each cell, each ceramic element moves inside each cell by the rotation or oscillation of the holder, as mentioned above. Consequently, with the aforementioned smooth flow communication of the plating solution, the effect of uniform deposition of an electroless plated film can further be enhanced.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A method of electroless plating, said method comprising:

providing a holder for electroless plating, said holder comprising a plurality of cells, each of which is adapted to house one of said plurality of ceramic elements, and each of said cells having such a structure permitting flow communication of a plating solution into the cell, said holder having a substantially elongated shape and comprising two walls arranged substantially parallel to each other, and a plurality of spacers linking said walls to each other at a plurality of points, and wherein said cells are distributed longitudinally and each is defined by a portion interposed between said walls and surrounded by spacers, at least one of said walls having at least one projection extending toward the inside of a cell to reduce the contact area of said wall with of a ceramic element therein, loading a ceramic element for a ceramic electronic part into at least one of said cells in said holder, and contacting at least one of said ceramic elements held by said holder with an electroless plating solution.

2. A method of electroless plating according to claim 1, wherein said holder is rotated or oscillated during said step of contacting said ceramic elements in the electroless plating solution.

3. A method of electroless plating according to claim 1, wherein said cells are adapted to form a point contact or line contact with said ceramic elements when present.

4. A method of electroless plating according to claim 1, wherein each of said cells has dimensions such that a ceramic element can move inside the cell when positioned therein.

5. A method of electroless plating according to claim 1, wherein said spacers are circular in cross section.

6. A method of electroless plating according to claim 5, wherein said projection has a rectangular cross section.

7. A method of electroless plating according to claim 5, wherein said projection has a triangular cross section.

8. A method of electroless plating, said method comprising the steps of:

providing a holder assembly for electroless plating, said holder assembly comprising a holder frame adapted to hold a plurality of holders arrayed two-dimensionally in such a manner that the longitudinal direction thereof are oriented in the same direction, each holder having an overall elongated shape and a plurality of cells distributed in its longitudinal direction, each holder adapted to house one of a plurality of ceramic elements, and each of said cells having such a structure permitting flow communication of a plating solution into the cell, wherein each said holder comprises two walls arranged substantially parallel to each other and a plurality of spacers linking said walls to each other at a plurality of points, and wherein each of said cells is defined by a portion interposed between said walls and surrounded by spacers, and wherein said plurality of holders are arranged in such a manner that aforesaid walls of said individual holders are arrayed two-dimensionally, and wherein spacers defining each of said cells comprise two groups of spacers, one being located on one of first and second holder bodies adjacent to each other and the other being located on the other of said adjacent first and second holder bodies, and an opening in each of said cells when said first and second holders are separated from each other, said opening being capable of receiving said ceramic element, loading a ceramic element for a ceramic electronic part into at least one of said cells in said holder assembly, and contacting at least one of said ceramic elements held by said holder with an electroless plating solution.

9. A method of electroless plating according to claim 8, wherein said holder assembly is rotated or oscillated during said step of contacting said ceramic elements in the electroless plating solution.

10. A method of electroless plating according to claim 9, wherein said holder assembly has gaps permitting flow communication of the plating solution between said individual walls of said plurality of holders arrayed two-dimensionally.

11. A method of electroless plating according to claim 10, wherein said spacers are circular in cross section.

12. A method of electroless plating according to claim 11, wherein at least one of said walls has at least one projection extending toward the inside of a cell to reduce the contact area of said wall with of a ceramic element therein.

13. A method of electroless plating according to claim 12, wherein said projection has a rectangular cross section.

14. A method of electroless plating according to claim 12, wherein said projection has a triangular cross section.

15. A method of electroless plating according to claim 8, wherein said cells are adapted to form a point contact or line contact with said ceramic elements when present.

16. A method of electroless plating according to claim 8, wherein each of said cells has dimensions such that a ceramic element can move inside the cell when positioned therein.

* * * * *